United States Patent [19]

Tuggle

[11] Patent Number: 4,940,028

[45] Date of Patent: Jul. 10, 1990

[54] RECOIL PULL ROPE REEL APPARATUS FOR INTERNAL COMBUSTION ENGINES

[75] Inventor: Lloyd H. Tuggle, Shreveport, La.

[73] Assignee: White Consolidated Industries, Inc., Cleveland, Ohio

[21] Appl. No.: 308,316

[22] Filed: Feb. 8, 1989

[51] Int. Cl.[5] ..... F02N 3/02

[52] U.S. Cl. ..... 123/185 B

[58] Field of Search ..... 123/185 A, 185 B, 185 BA, 123/185 BB

[56] References Cited

U.S. PATENT DOCUMENTS

| | | | |
|---|---|---|---|
| 2,348,547 | 5/1944 | Kissel | 123/185 BA |
| 2,563,719 | 8/1951 | Goldberg et al. | 123/185 BA |
| 2,772,669 | 12/1956 | Armstrong | 123/185 BA |
| 2,848,987 | 8/1958 | Morden | 123/185 BA |
| 2,868,186 | 1/1959 | Schnacke | 123/185 BA |

*Primary Examiner*—Andrew M. Dolinar

*Attorney, Agent, or Firm*—Hubbard, Thurman, Turner, Tucker & Harris

[57] ABSTRACT

A pull rope type starting apparatus for small internal combustion engines comprises a rope reel having a hub portion adapted to be rotatably mounted on a shaft driven by the piston(s) of the engine. A pair of axially spaced, radial flanges project from the hub to define an annular, relatively narrow rope-receiving cavity on the reel. A pull rope has a looped inner end portion anchored within a generally U-shaped channel formed on the outer side of one of the flanges. The rope extends from its clamped inner end loop around the reel hub to form a half hitch configuration and then passes through the clamped loop and a first aperture formed in the flange to which the inner rope end is clamped to lie intermediate the two radial flanges of the reel for winding within the annular reel cavity.

11 Claims, 1 Drawing Sheet

RECOIL PULL ROPE REEL APPARATUS FOR INTERNAL COMBUSTION ENGINES

BACKGROUND OF THE INVENTION

The present invention relates generally to recoil starting mechanisms for small internal combustion engines and, in a preferred embodiment thereof, more particularly provides improved pull rope reel apparatus in which a unique rope anchoring mechanism is incorporated.

Substantially all internal combustion engines under ten horsepower are typically provided with a hand operable, recoiltype starting mechanism in which a pull rope is wound around a reel structure which is spring-returned to its fully coiled position upon release of the pulled starter rope. One of the major sources of complaints registered against such recoil starting structures is that the inner end of the pull rope frequently becomes detached from the rope reel, thus making it necessary for the operator to either disassemble a portion of the engine housing to gain access to the rope reel, or take the entire machine to a repair shop.

While this problem has long been recognized, it must be balanced against the economic necessity of maintaining the manufacturing cost of such internal combustion engines at the lowest possible level which, it turn, dictates that the pull rope-to-reel anchoring mechanism must be simple and inexpensive, and must not appreciably increase the overall size of the rope reel. Heretofore, a wholly satisfactory pull rope-to-reel anchoring mechanism for a retractable pull rope starter for small internal combustion engines has not been provided.

It is accordingly an object of the present invention to provide a simple, inexpensive structure, which does not appreciably increase the overall reel size, for anchoring the inner end of a pull rope to a reel structure of the type used in recoil starting apparatus for small internal combustion engines.

SUMMARY OF THE INVENTION

In carrying out principles of the present invention, in accordance with a preferred embodiment thereof, an improved rope reel, for use in the recoil starting system of a small internal combustion engine, is provided with a specially designed mechanism for firmly anchoring the inner end of the pull rope to the reel in a manner essentially precluding the possibility that the inner rope end will become detached from the reel during the useful life of the rope.

The reel is conveniently formed from a suitable molded plastic material, or a metal material, and comprises a cylindrical hub portion to which first and second spaced apart radially outwardly projecting flanges are coaxially secured. The flanges define therebetween a relatively narrow, annular cavity within which the pull rope may be wound. On the portion of the hub which projects outwardly from the first flange a spaced series of ratchet teeth are formed which provide, in a conventional manner, the releasable driving connection between the reel and the engine's drive shaft typical of recoil-type pull rope starting systems.

The pull rope anchoring mechanism of the present invention, in a preferred embodiment thereof, comprises a small, generally U-shaped depression positioned on the outer side of the first reel flange adjacent the hub periphery and adapted to snugly receive a looped inner end portion of the pull rope. With the looped inner end portion of the rope received in the channel in this manner, a clamping screw element, having an enlarged head or a suitable washer member, is screwed into the first reel flange in a manner such that the head portion of the screw element firmly clamps the inner rope end loop into the channel against a gripping ridge formed thereon.

The anchored inner end loop of the rope passes generally around a first aperture formed axially through the first reel flange. This first aperture is just slightly larger than the cross section of the pull rope, and is directly across the annular reel cavity from a substantially larger second aperture formed axially through the second reel flange.

The pull rope is operatively installed on the reel by loosely wrapping a portion of the rope inwardly adjacent a first free end portion thereof around the hub and passing the second free end of the rope sequentially through the first flange aperture, axially across the reel cavity, and outwardly through the larger second aperture. The first free end portion of the rope is then passed inwardly around the rope portion extending into the first aperture and formed into an end loop which is pushed into the anchoring channel and secured therein using the clamping screw. The second free rope end projecting outwardly through the second aperture is then grasped and pulled to snug the rope around the hub portion in a resulting half-hitch configuration. The second free rope end is then inserted inwardly through the enlarged second aperture into the reel cavity and then further pushed to cause it to radially exit the cavity. This leaves a looped portion of the rope, positioned between its free and anchored ends, extending outwardly through the second flange aperture.

The second rope end projecting radially outwardly from the reel cavity is then grasped and pulled to draw this central looped portion of the rope inwardly through the second aperture and into the reel cavity, thereby readying the free portion of the pull rope to be wound in the usual manner within the reel cavity.

With the pull rope operatively installed on the reel in this manner, an inner end portion of the pull rope is frictionally and very firmly secured to the reel by two cooperating looped portions—the inner end loop which is clamped within the anchoring channel, and the adjacent loop which is snugged around the ratcheted hub in a half-hitch configuration. This simple, yet highly effective anchoring of an inner end portion of the pull rope to the reel essentially eliminates the possibility of rope separation from the reel during the useful life of the rope.

DETAILED DESCRIPTION

Figure 1:
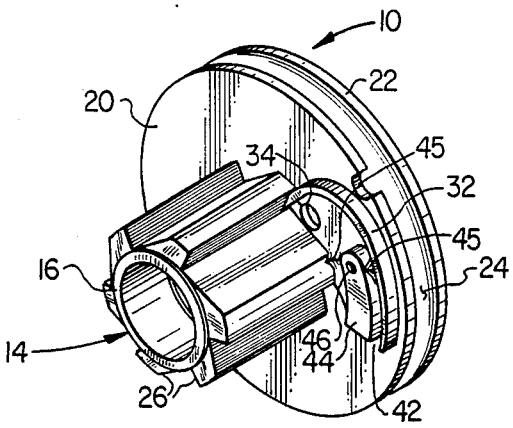
FIG. 1 is a perspective view of a pull rope reel which embodies principles of the present invention.
Figure 3:
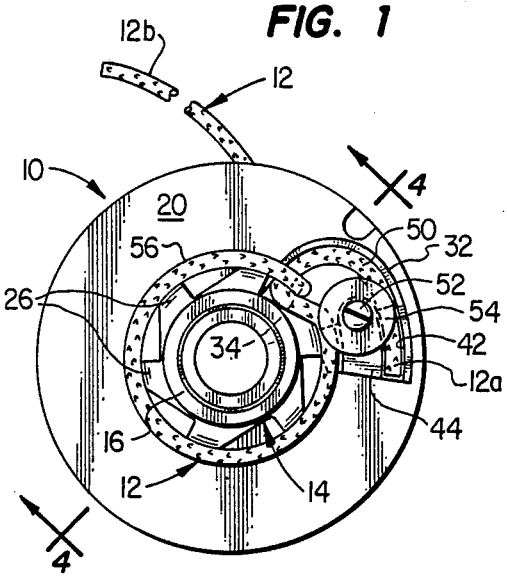
FIG. 3 is a view similar to that in FIG. 2 but with a pull rope operatively installed on the reel.
Figure 4A:
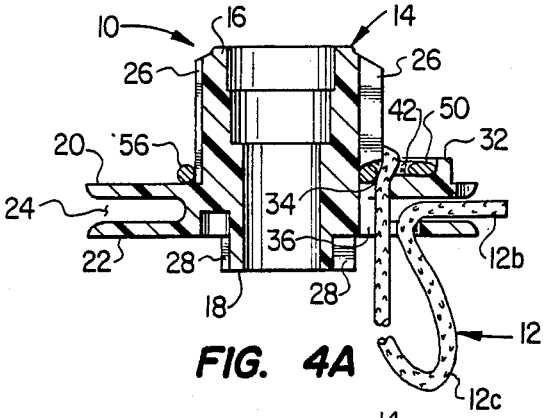
FIGS. 4–4C are cross-sectional views through the reel, taken along line 4—4 of FIG. 3, and sequentially illustrate the unique anchoring and installation of the pull rope on the reel.
Figure 4B:
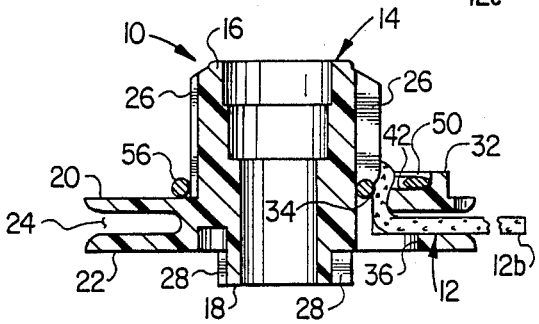

Perspectively illustrated in FIG. 1 is a pull rope reel 10 which embodies principles of the present invention and, in conjunction with a pull rope 12 (FIG. 3), is adapted for use in a recoil-type pull starting system of a small internal combustion engine of the type incorporated, for example, in lawn mowers, string trimmers, chain saws, outboard boat motors and the like. Reel 10 may be conveniently formed from a suitable molded plastic material and comprises a hollow cylindrical hub 14 having a left end portion 16, and a smaller diameter right end portion 18. Coaxially secured to the hub 14, between its end portions 16 and 18, are a longitudinally spaced pair of radially outwardly projecting circular flanges 20 and 22, flange 20 being above flange 22 as viewed in FIGS. 4–4C. The flanges 20 and 22 define therebetween an annular, relatively narrow reel cavity 24 within which a free portion of the rope 12 may be operatively coiled as best illustrated in FIG. 4C.

Formed around the peripheries of the hub end portions 16 and 18 are ratchet teeth 26 and 28 which, in a conventional manner, are operable to be drivingly connected with the engine's drive shaft during pull starting of the engine, but to be disengaged from the engine after it has been started and is being piston-driven. A representative example of the operation of the hub ratchet teeth used in conjunction with a recoil-type manual starting system may be found in co-pending U.S. patent application Ser. No. 253,303, filed on Sept. 30, 1988, assigned to the assignee of the present application. The disclosure of such co-pending application is hereby incorporated herein by reference. While ratchet teeth are incorporated in the illustrated rope reel 10, it will be appreciated from the subsequent description that the pull rope-anchoring method of the present invention is applicable to non-ratcheted rope reels as well.

For purposes later described, a curved wall 32 is formed on the outer side surface of flange 20 radially outwardly of the ratcheted hub portion 16. Additionally, a small aperture 34, slightly larger than the cross section of the rope 12, is formed through the flange 20 radially adjacent the hub end portion 16 and slightly to the right of the inner end of wall 32 as viewed in FIG. 2. Directly across the reel cavity 24 from the aperture 34 is a considerably larger aperture 36 formed through the flange 22.

A long standing and well known problem associated with rope and reel recoil starting systems has been the connection of the inner rope end to the reel. Specifically, conventional methods of securing the inner pull rope end to the reel often permit the connection to loosen over time such that during pull starting the rope simply comes off the reel. Because the reel is typically buried away within the engine's housing structure, this is a particularly annoying and aggravating problem to the operator of the device and typically requires considerable housing disassembly and reassembly simply to resecure the inner rope end to the reel and then reassemble the recoil starting structure. Alternatively, of course, the machine can simply be taken to a repair shop and the often considerable expense incurred simply to have a pull rope resecured to the reel.

Figure 2:
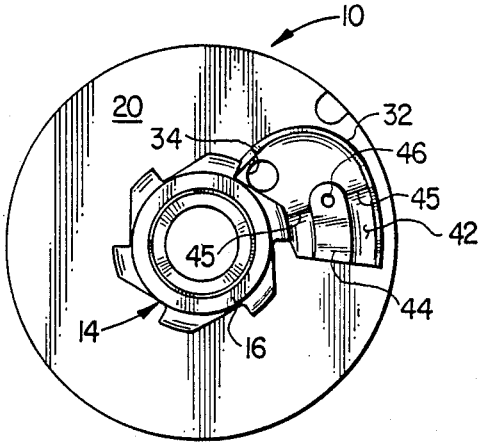
FIG. 2 is a left side elevational view of the reel.

The present invention essentially eliminates the possibility of the rope 12 being pulled off the reel 10 by providing a generally U-shaped depression or channel 42 bounded by the curved wall 32, the hub portion 16, and a raised flange portion 44 positioned between wall 32 and hub portion 16. A threaded opening 46 (FIGS. 1 and 2) is formed through the inner end of the raised portion 44. As best illustrated in FIG. 2, the flange aperture 34 lies within the closed end of channel 42. For purposes later described, gripping ridges 45 are formed on the bottom surface of the depression 42 and extend across the opposite leg portions thereof adjacent the threaded opening 46.

Figure 4:
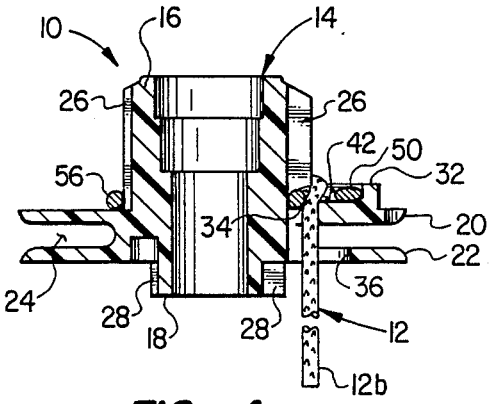
Figure 4C:
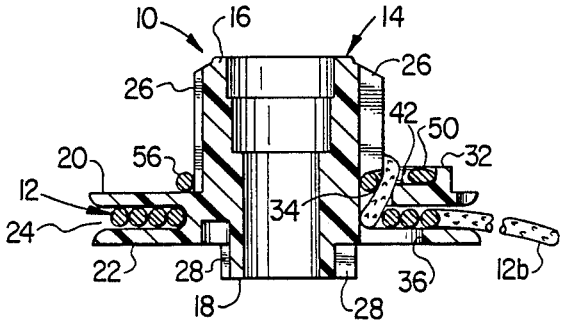

To very firmly secure the pull rope 12 to the reel 10, a portion 56 of the rope adjacent an inner end portion $12_a$ thereof is loosely wrapped around the hub portion 16 (FIG. 3) and the outer end $12_b$ of the rope is passed sequentially through the flange aperture 34, across the reel cavity 24, and outwardly through the flange aperture 36 (FIG. 4). The inner end portion $12_a$ of the rope is then passed inwardly around the end of loop 56 adjacent flange aperture 34, and formed into a bend or loop 50 which is pressed into the U-shaped channel 42. The inner end loop 50 is then firmly clamped within channel 42 by means of a clamping screw 52, having an enlarged head or washer 54, which is threaded into the opening 46 of the raised central portion 44 until the head or washer 54 is brought into engagement with opposite leg portions of the rope loop 50 to clamp them into the channel or depression 42 (against the gripping ridges 45) as best illustrated in FIG. 3.

Next, the free rope end $12_b$ is pulled downwardly (FIG. 4) to snug the half-hitched loop 56 around the hub portion 16. As illustrated in FIG. 4A, the free rope end $12_b$ is then inserted inwardly through the larger flange aperture 36 into the flange cavity 24 and pushed radially outwardly through the flange cavity, thereby leaving a central looped portion $12_c$ of the rope projecting outwardly from the flange aperture 36.

The free rope end $12_b$ is then pulled in a radially outward direction relative to the flanges 20, 22 to draw the central rope loop $12_c$ into the flange cavity 24 as illustrated in FIG. 4B. Finally, the rope 12 is wound within the flange cavity 24 as illustrated in FIG. $4_c$. The reel 10, with the rope 12 operatively wound thereon, is then ready for installation in the recoil starting system of the engine, and a suitable pull handle (not shown) may be appropriately secured to the free rope end $12_b$.

The use of the previously described clamping structure, which includes the anchoring member 40 and the clamping screw 52, very firmly secures an inner, looped end portion of the rope 12 to the outer side of the flange 20. Coupled with the halfhitched rope loop 56, this clamping structure essentially eliminates the separation of the rope 12 from the reel 10 during the useful life of the pull rope. It is to be noted that, when the rope 12 is pulled during engine starting to completely unwind the rope from the reel 10, the half-hitched rope loop 56, due to its frictional engagement with the hub portion 16, substantially reduces the direct pulling force transmitted to the clamped rope loop portion 50, thereby substantially strengthening the rope-to-reel connection.

The use of the rope clamping structure of the present invention provides a very economical method of firmly securing the rope to the reel, and does not appreciably increase the size of the overall reel structure. Additionally, such clamping structure is quite easy to use and provides for the relatively rapid installation of the original pull rope, or a replacement pull rope, on the reel.

The foregoing detailed description is to be clearly understood as being given by way of illustration and example only, the spirit and scope of the present invention being limited solely by the appended claims.

What is claimed is:

1. A rope reel for use in conjunction with a pull rope in a manual, recoil type starting system in an internal combustion engine, said rope reel comprising:

a hub extending along an axis;

first and second radially outwardly projecting flanges coaxially secured to said hub in an axially spaced relationship thereon and defining therebetween an annular cavity within which the pull rope may be operatively wound, each of said first and second flanges having outer and inner sides, an axial portion of said hub projecting outwardly from said first flange;

anchoring means, positioned on said outer side of said first flange, for clampingly securing an inner end portion of the pull rope on said outer side of said first flange; and a first aperture formed axially through said first flange radially adjacent said projecting axial portion of said hub, said first aperture being sized, and circumferentially positioned on said first flange, in a manner permitting a second portion of the pull rope adjacent the clamped inner end portion thereof to be at least partially looped around said projecting axial portion of said hub and the free end of the pull rope inserted inwardly through said first aperture into said annular cavity and moved radially outwardly therethrough to snug the second pull rope portion around said projecting axial portion of said hub and ready the pull rope for operative winding thereof within said annular cavity;

said anchoring means being operative to clamp a looped inner end portion of the pull rope on said outer side of said first flange and position said looped inner end portion to extend externally around said first aperture in a manner permitting said second pull rope portion to be wrapped entirely around said projecting axial portion to be wrapped entirely around said projecting axial portion of said hub, and permit the free and portion of the pull rope to be inserted sequentially through said looped inner end portion, inwardly through said first aperture and into said annular cavity for subsequent movement radially outwardly therethrough.

2. The rope reel of claim 1 wherein:

said anchoring means include raised wall means positioned on said outer side of said first flange for defining a generally U-shaped channel thereon for receiving the looped inner end portion of the pull rope, and clamping means for engaging the received, looped inner end portion of the pull rope and clamping it within said channel.

3. The rope reel of claim 2 wherein:

said clamping means include screw means threadable into said first flange between opposite leg portions of the received, looped inner end portion of the pull rope and having an enlarged head portion adapted to overlie the opposite leg portions and clamp the same to said first flange.

4. The rope reel of claim 3 wherein said clamping means further include:

gripping ridge means, formed on the surface of said channel and positioned to underlie portions of the pull rope clamped by said head portion, for gripping the pull rope and facilitating the retention thereof within said channel.

5. A rope reel for use in conjunction with a pull rope in a manual, recoil type starting system in an internal combustion engine, said rope reel comprising:

a hub extending along an axis;

first and second radially outwardly projecting flanges coaxially secured to said hub in an axially spaced relationship thereon and defining therebetween an annular cavity within which the pull rope may be operatively wound, each of said first and second flanges having outer and inner sides, an axial portion of said hub projecting outwardly from said first flange;

anchoring means, positioned on said outer side of said first flange, for clampingly securing an inner end portion of the pull rope on said outer side of said first flange; and a first aperture formed axially through said first flange radially adjacent said projecting axial portion of said hub, said first aperture being sized, and circumferentially positioned on said first flange, in a manner permitting a second portion of the pull rope adjacent the clamped inner end portion thereof to be at least partially looped around said projecting axial portion of said hub and the free end of the pull rope inserted inwardly through said first aperture into said annular cavity and moved radially outwardly therethrough to snug the second pull rope portion around said projecting axial portion of said hub and ready the pull rope for operative winding thereof within said annular cavity; and a second aperture formed axially through said second flange directly across said annular cavity from said first aperture, said second aperture being sized to simultaneously receive two thicknesses of the pull rope in a manner such that after the free pull rope end is pushed inwardly through said first aperture into said annular cavity the free pull rope end may sequentially be pushed outwardly through said second aperture, inserted inwardly through said second aperture into said annular cavity and pushed radially outwardly therefrom to form a looped pull rope portion projecting outwardly from said second aperture, and then pulled radially outwardly from said annular cavity to draw the outwardly projecting pull rope loop through said second aperture into said annular cavity to ready the pull rope for operative winding therein.

6. Recoil starting apparatus for an internal combustion engine, comprising:

a rope reel having a hub extending along an axis, first and second radially outwardly projecting flanges coaxially secured to said hub in an axially spaced relationship thereon and defining therebetween an annular cavity within which a starter pull rope may be operatively wound, each of said first and second flanges having outer and inner sides, an axial portion of said hub projecting axially outwardly from said first flange, and a first aperture formed axially through said first flange radially adjacent said axially projecting hub portion; and a starter pull rope operatively wound within said annular cavity of said rope reel, said starter pull rope having a looped inner end portion anchored on said outer side of said first flange radially adjacent said axially projecting hub portion and extending outwardly around said first aperture, and a second portion extending circumferentially around said axially projecting hub portion and passing inwardly through said looped inner end portion, and said first aperture, into said annular cavity.

7. The recoil starting apparatus of claim 6 wherein:

said looped inner end portion is anchored to said outer side of said first flange, within a generally U-shaped depression formed thereon, by a screw member threadably received in said first flange and having an enlarged head portion overlying opposite leg portions of said looped inner end portion and releasably clamping them within said depression.

8. The recoil starting apparatus of claim 7 wherein:

said depression has a surface upon which gripping ridge means are formed that underlie and frictionally grip said opposite leg portions of said looped inner end portion of said starter pull rope.

9. The recoil starting apparatus of claim 6 further comprising:

a second aperture formed through said second flange directly across said annular cavity from said first aperture and sized to simultaneously receive two thicknesses of said starter pull rope.

10. A method of fabricating a manual, recoil-type pull start system for an internal combustion engine, said method comprising the steps of:

providing a rope reel having a hub extending along an axis, and first and second radially outwardly projecting flanges coaxially secured to said hub in an axially spaced relationship thereon and defining therebetween an annular cavity within which a starter pull rope may be operatively wound, each of said first and second flanges having outer and inner sides, an axial portion of said hub projecting axially outwardly from said first flange;

forming a first aperture axially through said first flange radially adjacent said axially projecting hub portion;

forming a second aperture through said second flange directly across said annular cavity from said first aperture;

providing a starter pull rope having inner and outer ends;

forming a generally U-shaped loop in an inner end portion of said starter pull rope;

anchoring said loop on said outer side of said first flange in a manner such that said loop extends outwardly around said first aperture;

wrapping a longitudinal portion of said starter pull rope, adjacent said loop, around said axially projecting hub portion;

passing said free end portion of said starter pull rope sequentially through said loop, inwardly through said first aperture, across said annular cavity, outwardly through said second aperture, inwardly through said second aperture to form a looped portion of said starter pull rope projecting outwardly through said second aperture, and then radially outwardly through said annular cavity;

radially pulling said free end of said starter pull rope to draw said outwardly projecting looped portion of said starter pull rope inwardly through said second aperture into and through said annular cavity; and operatively winding the resulting free portion of said starter pull rope within said annular cavity.

11. The method of claim 10 wherein said step of anchoring said loop on said outer side of said first flange is performed by:

forming a generally U-shaped depression on the outer side of said first flange adjacent said first aperture;

positioning said generally U-shaped rope loop in said generally U-shaped depression;

providing a screw member having a transversely enlarged head portion; and threading said screw member into said first flange between opposite leg portions of said generally U-shaped rope loop to bring said head portion into releasably clamping engagement therewith.

* * * * *